US012607108B2

(12) United States Patent
Startz et al.

(10) Patent No.: US 12,607,108 B2
(45) Date of Patent: Apr. 21, 2026

(54) SYSTEMS AND METHODS FOR CONTROL OF A MULTICHANNEL FRACTURING PUMP CONNECTION

(71) Applicant: Force Pressure Control, LLC, Seguin, TX (US)

(72) Inventors: Jacob Startz, Seguin, TX (US); Dustin Nesloney, Orange Grove, TX (US)

(73) Assignee: Force Pressure Control, LLC, Seguin, TX (US)

( * ) Notice: Subject to any disclaimer, the term of this patent is extended or adjusted under 35 U.S.C. 154(b) by 0 days.

(21) Appl. No.: 18/999,657

(22) Filed: Dec. 23, 2024

(65) Prior Publication Data

US 2025/0122791 A1 Apr. 17, 2025

Related U.S. Application Data

(63) Continuation of application No. 18/418,498, filed on Jan. 22, 2024, now Pat. No. 12,221,873, which is a continuation of application No. 18/097,591, filed on Jan. 17, 2023, now Pat. No. 11,913,318, which is a continuation of application No. 17/512,051, filed on Oct. 27, 2021, now Pat. No. 11,585,200.

(51) Int. Cl.
*E21B 43/26* (2006.01)
*E21B 34/02* (2006.01)

(52) U.S. Cl.
CPC ..... *E21B 43/2607* (2020.05); *E21B 34/02* (2013.01); *E21B 43/26* (2013.01)

(58) Field of Classification Search
CPC ..... E21B 43/2607; E21B 34/02; E21B 43/26
See application file for complete search history.

(56) References Cited

U.S. PATENT DOCUMENTS

| | | | |
|---|---|---|---|
| 3,313,347 | A | 4/1967 | Crain |
| 7,841,394 | B2 | 11/2010 | McNeel et al. |
| 8,839,867 | B2 | 9/2014 | Conrad |
| 8,978,763 | B2 | 3/2015 | Guidry |
| 9,068,450 | B2 | 6/2015 | Guidry |
| 9,222,345 | B2 | 12/2015 | Conrad |
| 9,255,469 | B2 | 2/2016 | Conrad |
| 9,518,430 | B2 | 12/2016 | Guidry |

(Continued)

FOREIGN PATENT DOCUMENTS

| | | |
|---|---|---|
| CA | 3024863 | 11/2017 |
| CN | 102121363 A | 7/2011 |

(Continued)

*Primary Examiner* — James G Sayre
(74) *Attorney, Agent, or Firm* — RegitzMauck PLLC; Dustin Mauck; Mike Regitz

(57) ABSTRACT

The present invention includes systems and methods for continuous fracturing operations across a multichannel fracturing configuration. To swap a first well for a second well while continuously pumping water and/or frac fluid through the fracturing system, the second well may be initially prepared through a pressure equalization process. Once the second well is equalized and open, the first well may be sequentially closed and depressurized. Thus, the first well is swapped for the second well while the water and/or frac fluid continuously flows through the system. A conditional flow control valve may be used to sequentially open and/or close the flow of frac fluid through the frac manifold.

19 Claims, 8 Drawing Sheets

(56) References Cited

U.S. PATENT DOCUMENTS

| | | | |
|---|---|---|---|
| 9,605,525 | B2 | 3/2017 | Kajaria et al. |
| 9,631,469 | B2 | 4/2017 | Guidry et al. |
| 9,644,443 | B1 | 5/2017 | Johansen et al. |
| 9,903,190 | B2 | 2/2018 | Conrad et al. |
| 9,915,132 | B2 | 3/2018 | Conrad |
| 9,932,800 | B2 | 4/2018 | Guidry |
| 10,094,195 | B2 | 10/2018 | Guidry |
| 10,132,146 | B2 | 11/2018 | Guidry |
| 10,323,475 | B2 | 6/2019 | Christopherson et al. |
| 10,378,326 | B2 | 8/2019 | Morris et al. |
| 10,385,637 | B2 | 8/2019 | Marr |
| 10,385,643 | B2 | 8/2019 | Guidry |
| 10,385,645 | B2 | 8/2019 | Guidry |
| 10,385,662 | B2 | 8/2019 | Conrad |
| 10,487,637 | B2 | 11/2019 | Guidry et al. |
| 10,619,471 | B2 | 4/2020 | Kajaria et al. |
| 10,787,879 | B2 | 9/2020 | Christopherson et al. |
| 10,934,816 | B2 | 3/2021 | Conrad |
| 11,401,779 | B2 | 8/2022 | Kuehn et al. |
| 11,560,770 | B2 | 1/2023 | Kuehn et al. |
| 11,585,200 | B1 | 2/2023 | Startz et al. |
| 2014/0352968 | A1* | 12/2014 | Pitcher ..... E21B 43/2607 166/308.1 |
| 2020/0115983 | A1 | 4/2020 | Nanney |
| 2020/0248529 | A1 | 8/2020 | Beason et al. |
| 2020/0270953 | A1 | 8/2020 | Ziegler et al. |
| 2020/0318460 | A1 | 10/2020 | Twardowski et al. |
| 2020/0386359 | A1 | 12/2020 | Johnson et al. |
| 2022/0112797 | A1* | 4/2022 | Beuterbaugh ..... E21B 43/2607 |
| 2022/0268141 | A1 | 8/2022 | Krupa et al. |

FOREIGN PATENT DOCUMENTS

| | | |
|---|---|---|
| GB | 1101070 | 1/1968 |
| GB | 2099883 A | 12/1982 |
| WO | WO 2020145978 | 7/2020 |

* cited by examiner

SYSTEMS AND METHODS FOR CONTROL OF A MULTICHANNEL FRACTURING PUMP CONNECTION

PRIORITY CLAIM

This application claims priority to and is a continuation application of U.S. patent application Ser. No. 18/418,498 that was filed on Jan. 22, 2024, which claims priority to and is a continuation of patent application Ser. No. 18/097,591 that was filed on Jan. 17, 2023, and issued as U.S. Pat. No. 11,913,318, which claims priority to and is a continuation application of U.S. patent application Ser. No. 17/512,051 that was filed on Oct. 27, 2021, and issued as U.S. Pat. No. 11,585,200.

TECHNICAL FIELD

The present invention relates generally to a method and system for controlling a fracturing pump connection with multiple channels, and more specifically, remotely controlling and managing multiple fluid paths within a fracturing system to enable continuous pumping through multiple channels.

BACKGROUND OF THE INVENTION

Hydraulic fracturing or "fracking" is an oil and gas well process that involves injecting water, sand, and/or other chemicals into a bedrock formation at high pressures. The water, sand, and/or other chemicals injected at high pressures are designed to further fracture the bedrock by increasing the size of current fractures and creating new fractures for the hydrocarbons to escape through. Production can be achieved when the pore spaces or fractures are connected and permeable to allow the transmission of fluid through these areas. The corresponding solution then flows through the bedrock and into the well. After the solution is extracted from the well, the oil and gas can be separated from the water, sand, and/or other chemicals for production.

These types of stimulation techniques encourage the flow of hydrocarbons from the fractures in the reservoir rocks. Initially, the frac fluids are injected into the well to increase the pressure in the well to further fracture or create new fractures in the bedrock. Then, additional frac fluid and propping agents (e.g., quartz sand grains, ceramic spheres, or aluminum oxide pellets) are introduced into the well to hold the fractures open after pumping has ceased. Now, with the fractured rocks open and permeable, the well is back flushed to remove all the frac fluids. Fracturing the well can increase the production by 1.5 to 30 times.

With the high pressures involved and the large volumes of water, sand, chemicals, and propping agents, the hydraulic fracturing operation must be set up properly and safely. Fracturing pumps help deliver the water or solution from the frac tanks to the wellheads through an intricate arrangement of valves and connections. In combination, the pumps, valves, and connections control the pressure, timing, and fluid for the pumping operation. In most fracturing operations, multi-well pads with multiple well bores are used to fracture large areas of bedrock, which increases efficiency.

One of the drawbacks of prior solutions for fracturing operations is that alternating between multiple well bores would require the operators to completely shut down one well bore before diverting the high-pressure fluid to the next well bore. This increases the time and resources required to operate through multiple well bores. The ability to sequentially apply high-pressure liquid to multiple well bores without the need to shut down the high-pressure stimulation pumps is desired.

BRIEF SUMMARY OF THE INVENTION

The present invention comprises systems and methods for management and control of a multichannel fracturing pump connection. According to certain embodiments, an operator can swap a first well for a second well in a multiple well fracturing configuration by gradually preparing said second well to begin fracturing operations and then sequentially shutting down fracturing operations on said first well to enable continuous fracturing operations across numerous wells. This method is an improvement because an operator is not required to shut down a first well before beginning operations on a second well, which saves time and resources for the fracturing operation. Thus, the high-pressure stimulation pumps do not need to be shut down and restarted.

In some embodiments, the present invention involves initially preparing the second well for fracturing operations. First, depending upon the configuration of the corresponding frac tree and frac manifold, pumpdown valves or equalizing valves on the frac tree are opened. Then a flow control valve on the frac manifold is opened, which enables water and/or frac fluid to enter the frac manifold leg and corresponding frac tree. Once the pressure is equalized, the flow control valve is closed to trap pressure between the flow control valve and zipper valves on the frac manifold. Then zipper valves on the frac manifold are opened and pressure is equalized. Lastly, a master valve is opened and the pumpdown valves are closed at the frac tree. At this point, the second well is prepared to start fracturing operations.

In some embodiments, the operator then swaps wells to cease pumping on the first well and initiate pumping on the second well. Initially, the flow control valve is opened for the second well and a flow control valve for the first well is closed sequentially. For example, the flow control valve of the first well may be initially closed to 50% of the flow rate, and then to 0% (completely closed). A pressure may be observed at the flow control valve before completely closing said flow control valve. A master valve(s) for the first well is then closed, and the pressure from the first well is bled off. The first well is now closed and full fracturing operations can begin on the second well. Through this method, the well swap can occur without shutting down the entire fracturing operation.

The present invention further comprises a conditional value flow control valve that may switch between numerous conditions—not just "open" or "closed." This type of valve enables the flow control valve of the frac manifold to close in stages or gradually close. The corresponding flow control valve may include a piston connected to a stem and gate. A hydraulic pressure system (or other type of pressure system) may control movement of the piston. A multi-level seat is then used to engage the gate at various positions within the housing, where the positioning of the gate determines the flow rate through the frac manifold. This type of valve enables the fracturing system to sequentially close the flow control valve during the well swap procedure.

In some embodiments, these methods are performed remotely through a control system. The structures of the fracturing system (fluid supplies, fluid controllers, pumps, frac manifolds, frac trees, valves, wellheads) may have sensors and transceivers to report pressures, progress, events, and status of the fracturing system. Then an operator or a computer software program may control the fracturing system based upon these data points. This may be done onsite or remotely through the control system. For example, the steps above may be achieved through commands from the system control to the fluid controllers and valves to swap wells and continue pumping through a multiple well configuration.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

In the past, operators of a fracturing system that comprised more than one well would have to fully shut down the first well before they could move to the second well. Then they would have to completely shut down the second well before moving to the third well. Many fracturing system configurations comprise a large number of wells, which means that numerous full shut-downs are required to complete the fracturing operation. The present invention enables the fracturing operation to continually pump water and/or frac fluid through the fracturing system as the operation moves from one well to the next. Thus, the corresponding pumps and other fracturing equipment may continually run until the entire fracturing operation is complete.

Figure 1:
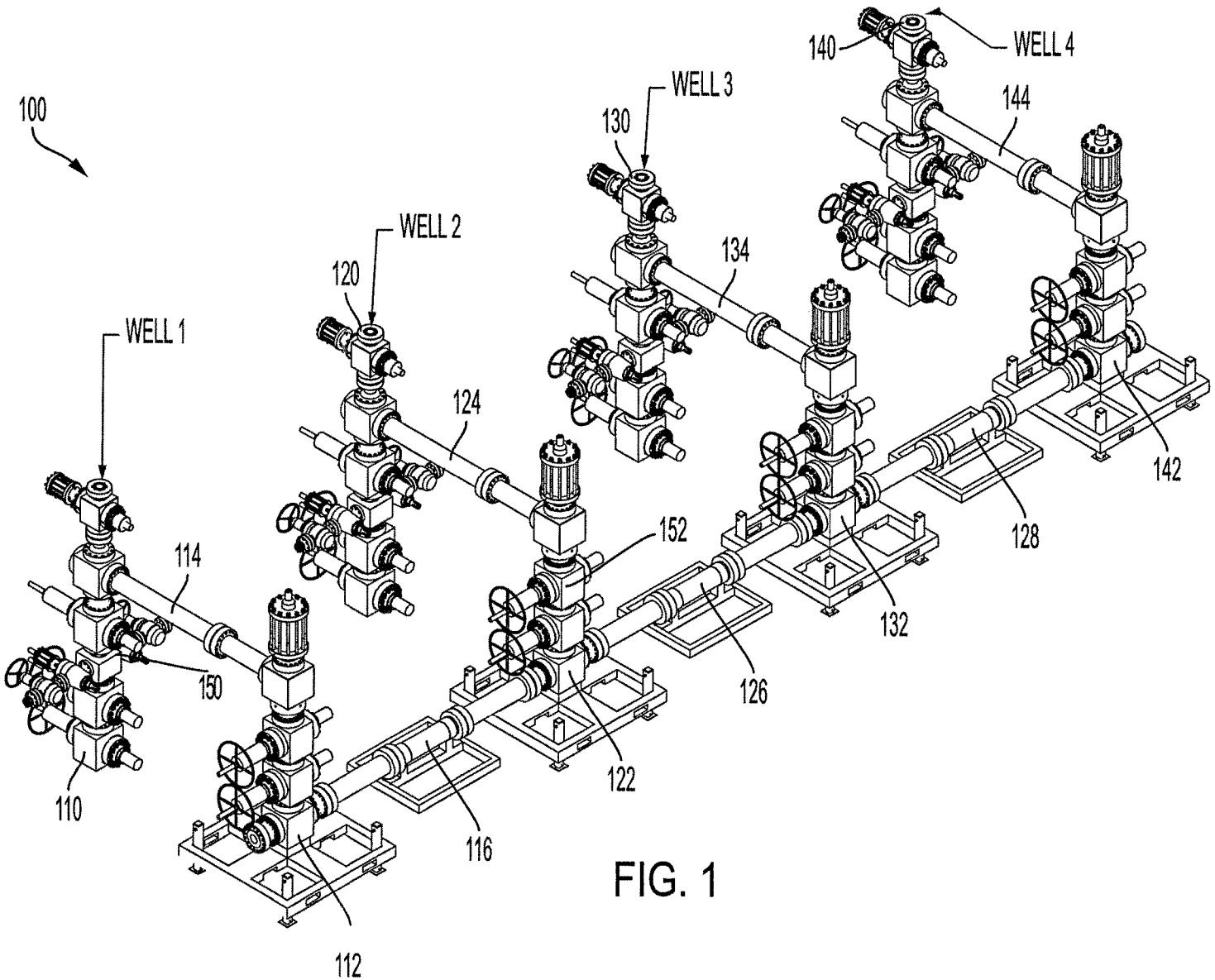
FIG. 1 shows a four well fracturing system 100 according to certain embodiments of the present invention.

FIG. 1 shows a four-well fracturing system 100 according to certain embodiments of the present invention. A frac manifold is made up of four separate portions with one for each well 112, 122, 132, 142. First portion 112 is connected to a first frac tree 110 through a first fluid connector 114. Second portion 122 is connected to a second frac tree 120 through a second fluid connector 124. Third portion 132 is connected to a third frac tree 130 through a third fluid connector 134, and fourth portion 142 is connected to a fourth frac tree 140 through a fourth fluid connector 144. The fluid connectors 114, 124, 134, 144 supply frac fluids from the portions of the frac manifold 112, 122, 132, 142 to the frac trees 110, 120, 130, 140. Further, the portions of the frac manifold are fluidly connected through fluid connections 116, 126, 128. With these fluid connections 116, 126, 128, the system 100 may transport water from Well 1 to Well 4 or from Well 4 to Well 1. Thus, the fluid supply (not shown) can be connected to different portions of the frac manifold 112, 122, 132, 142, but supply frac fluids to all of the frac trees 110, 120, 130, 140 and corresponding Wells (1, 2, 3, 4).

As will be further described below, at least one equalizing valve 150 may be used on each frac tree and at least one hydraulic valve 152 may be used on each frac manifold. FIGS. 2-6 will describe these features in further details. The valves control the directions and pressures of the frac fluids in the frac system 100. Specifically, valves located at the portions of the frac manifold 112, 122, 132, 142 and frac trees 110, 120, 130, 140 may be used in conjunction to deliver the frac fluids to any of the Wells (1, 2, 3, 4), thereby enabling one fracturing system 100 to operate through four separate wells. Due to the vast volumes of frac fluids and the high pressures involved with fracturing a well, the valves must be reliable and must be operated with precision.

Figure 2:
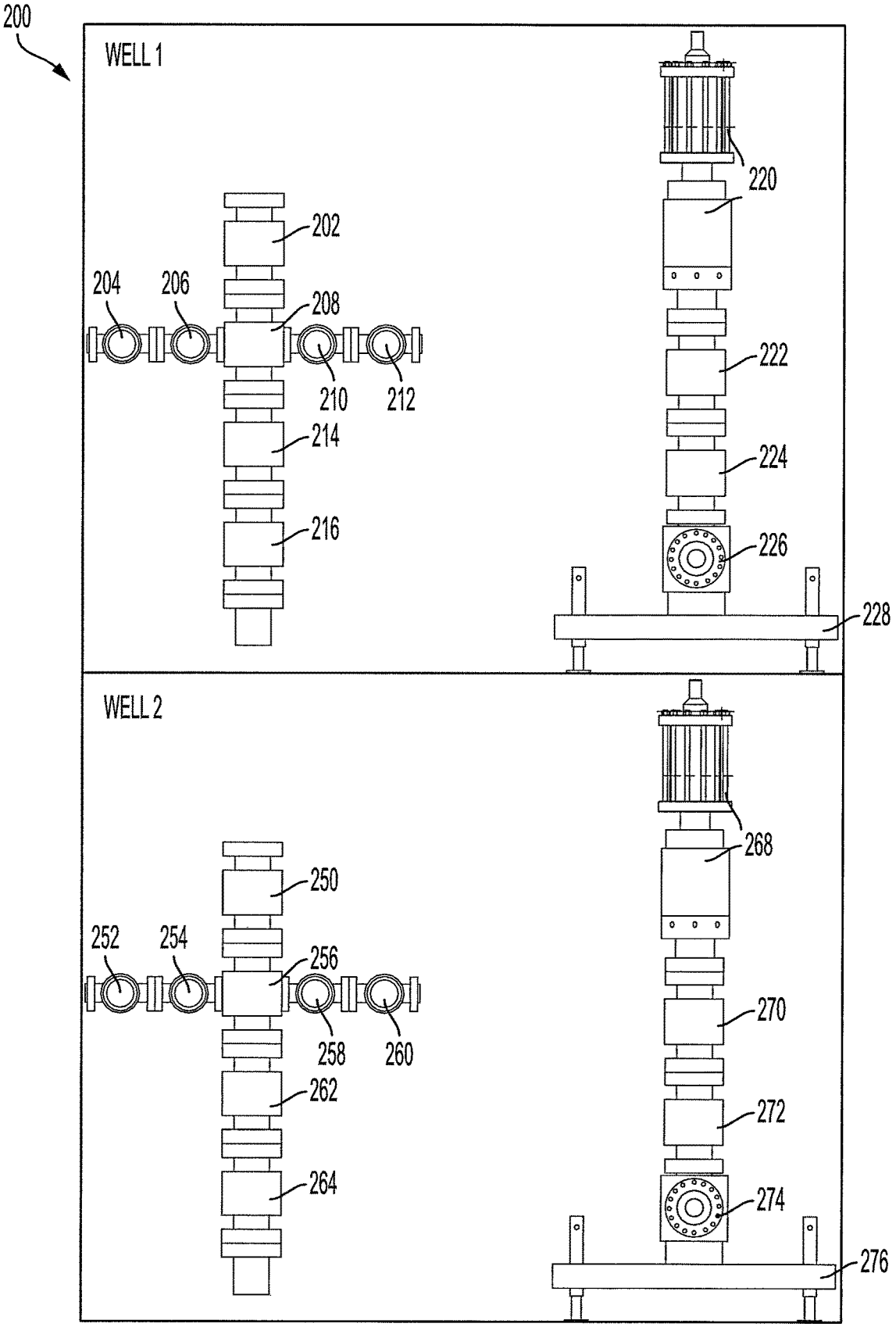
FIG. 2 shows two wells with frac trees and frac manifolds that operate according to certain embodiments of the present invention.

FIG. 2 shows two wells 200 (Well 1 and Well 2) that may operate according to the claimed invention. Well 1 and Well 2 show a portion of a frac manifold and a frac tree on a wellhead. As shown in FIG. 1, each portion of the frac manifold may be connected to a corresponding frac tree, but this figure does not include these connections. FIG. 1 is an illustration of the entire system 100 at a site, whereas FIGS. 2-5 illustrate two wells of the system and the corresponding frac manifolds and frac trees for ease of description. In some embodiments of the present invention, an operator can begin pumping on Well 2 before completely shutting down Well 1 to enable continuous pumping through a number of wells. This patent application covers and describes numerous scenarios and configurations to enable continuous pumping, however, the present invention is not limited to these scenarios and configurations. The scenarios provided in FIGS. 2-5 are merely preferred embodiments designed to describe the features of the present invention.

In the configuration shown in FIG. 2, the two frac manifold portions and frac trees are similar. Swab valves 202, 250, crosses 208, 256, upper master valves 214, 262, and lower master valves 216, 264 make up the vertical portion of the frac trees for Well 1 and Well 2. Flowback valves 204, 206, 252, 254 and pumpdown valves 210, 212, 258, 260 make up the horizontal portions of frac trees for Well 1 and Well 2. The frac trees shown in FIG. 2 represent the frac trees 110, 120, 130, and 140 shown in FIG. 1. Tree caps are not shown in FIG. 2. Flow control valves 220, 268, upper zipper valves 222, 270, lower zipper valves 224, 272, and connection blocks 226, 274 make up the frac manifolds for Well 1 and Well 2. Skids 228, 276 are used to anchor the frac manifolds for Well 1 and Well 2. The portions of the frac manifold shown in FIG. 2 represent frac manifold portions 112, 122, 132, and 142 in FIG. 1.

In some embodiments, swab valves and master valves on the frac tree are designed to control the fluid going into the well. By leaving these valves open, the frac fluid can enter the well, but if these valves are closed, then the frac fluid cannot enter the well. The crosses are designed to connect the various valves in the frac tree. Flowback valves are designed to be used during fracturing operations, wherein the frac fluid and/or production fluid can escape the well during fracturing operations. Pumpdown valves are designed to be used to allow fluid for wireline operations to enter the well, but can also be used to bleed off pressure from the well. With respect to the frac manifold, the connection block is designed to be connected to a fluid supply or another frac manifold portion to enable the water and/or frac fluid to reach the frac tree. The flow control valves and the zipper valves are designed to control the fluid going to the frac tree. By leaving these valves open, the frac fluid can travel from the frac manifold to the frac tree, but if these valves are closed, then the frac fluid does not flow to the frac tree. Through the use of these connectors and valves, an operator can control the frac fluid going into the well and the production fluid exiting the well.

Figure 6:
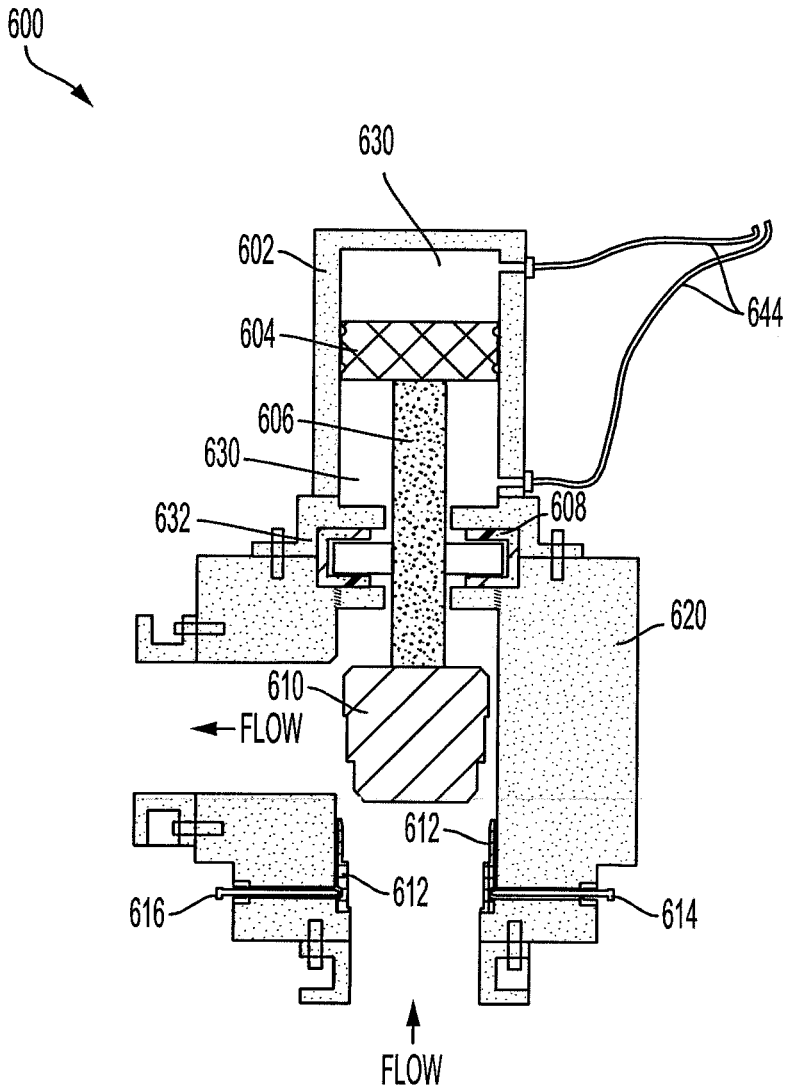
FIG. 6 shows a flow control valve that may operate in a frac manifold according to certain embodiments of the present invention.

For the scenario shown in FIG. 2, Well 1 is fracking at close to 9,000 psi treating pressure and Well 2 has been bled off and is at 0 psi above the upper master valve 262. Now it is time to prepare for the well swap from Well 1 to Well 2. Initially, the pumpdown valves 258, 260 are opened on the frac tree for Well 2. Then, flow control valve 268 is partially opened to allow pressure to access upper zipper valve 270 and lower zipper valve 272. FIG. 6 further describes a variable condition flow control valve that may allow flow control valve 268 to partially open with a desired flow rate. The operator then must equalize Well 2 wellhead pressure with Well 1 frac treating pressure utilizing pumpdown pumps (not shown), thereby creating minimal pressure differential across upper zipper valve 270 and lower zipper valve 272. Once the pressure differential is achieved, close flow control valve 268 to trap the equivalent treating pressure between the zipper valves 270, 272 and the flow control valve 268. Open zipper valves 270, 272, then bleed off pressure and equalize wellhead pressure with Well 2 formation pressure utilizing pumpdown bleed off line (not shown), or with flowback valves 252, 254. After the pressure is equalized, open upper master valve 262. Then close pumpdown valves 258, 260 and bleed off pressure in pumpdown lines (not shown). Well 2 is now open and ready for fracturing operations. Make sure to allow adequate time to achieve these steps before swapping wells and finishing the stage on Well 1. In some embodiments it is not necessary to equalize the pressure or achieve equivalent pressure, but is sufficient to stabilize the pressure to the requirements of the fracturing system.

Once the fluid flush and overflush volumes have reached the perforated areas of the well, open flow control valve 268 on Well 2 to 100%, and close flow control valve 220 on Well 1 to 50% open and observe the pressure there. Once the pressure has stabilized, close flow control valve 220 on Well 1 to 0% open. This may be called sequentially or incrementally closing the flow control valve 220. Other types of sequential or incremental closing of the flow control valve 220 (See FIG. 6) are within the scope of the present invention (e.g., 75%, 50%, 0%). While specific pressures and % flow rate values are included in this description, the present invention is not limited to those pressures and % flow rate values. Other pressures and values for the flow control valve are within the scope of the present invention. Then close upper master valve 214 on Well 1. Equalize the pumpdown iron (not shown) to the wellhead pressure of Well 1 and open pumpdown valves 210, 212. Then open pumpdown bleed-off line to flowback tank, allowing the pressure in the wellhead of Well 1 to reach zero or allow the pressure to escape through flowback valves 204, 206. Now the pressure on Well 2 can be increased as allowed and the next frac stage for Well 2 can be achieved. At this point, Well 1 is bled off to 0 psi and is prepared for wireline operations and Well 2 can begin the next stage. This process allows for a continuous transition from Well 1 to Well 2.

Figure 3:
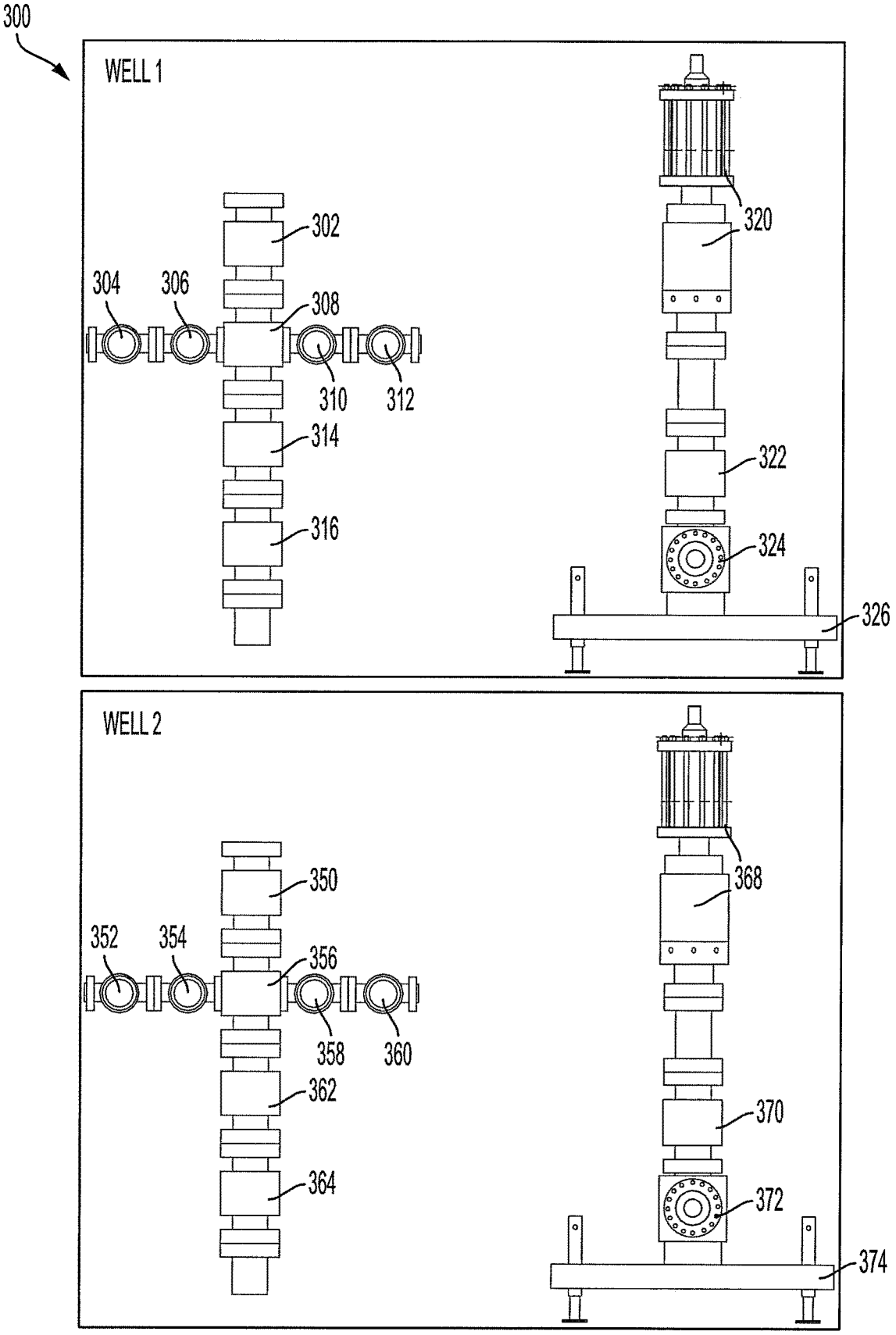
FIG. 3 shows an alternative embodiment for two wells with frac trees and frac manifolds that operate according to certain embodiments of the present invention.

In the configuration shown in FIG. 3, the two frac manifold portions and frac trees are similar for Well 1 and Well 2 300. The configurations shown in FIGS. 2 and 3 are similar. Swab valves 302, 350, crosses 308, 356, upper master valves 314, 362, and lower master valves 316, 364 make up the vertical portion of the frac trees for Well 1 and Well 2. Flowback valves 304, 306, 352, 354 and pumpdown valves 310, 312, 358, 360 make up the horizontal portions of frac trees for Well 1 and Well 2. Tree caps are not shown in FIG. 3. Flow control valves 320, 368, zipper valves 322, 370, and connection blocks 324, 372 make up the frac manifolds for Well 1 and Well 2. Skids 326, 374 are used to anchor the frac manifolds for Well 1 and Well 2. The portions of the frac manifold shown in FIG. 3 represent frac manifold portions 112, 122, 132, and 142 in FIG. 1.

For the scenario shown in FIG. 3, Well 1 is fracking at close to 9,000 psi treating pressure and Well 2 has been bled off and is at 0 psi above the upper master valve 362. Now it is time to prepare for the well swap from Well 1 to Well 2. Initially, the pumpdown valves 358, 360 are opened on the frac tree for Well 2. Then, flow control valve 368 is partially opened to allow pressure to access zipper valve 370. The operator then must equalize Well 2 wellhead pressure with Well 1 frac treating pressure utilizing pumpdown pumps (not shown), thereby creating minimal pressure differential across zipper valve 370. Once the pressure differential is achieved, close flow control valve 368 to trap the equivalent treating pressure between the zipper valve 370 and the flow control valve 368. Open zipper valve 370, then bleed off pressure and equalize wellhead pressure with Well 2 formation pressure utilizing pumpdown bleed off line (not shown), or with flowback valves 352, 354. After the pressure is equalized, open upper master valve 362. Then close pumpdown valves 358, 360 and bleed off pressure in pumpdown lines (not shown). Well 2 is now open and ready for fracturing operations. Make sure to allow adequate time to achieve these steps before swapping wells and finishing the stage on Well 1.

Once the fluid flush and overflush volumes have reached the perforated areas of the well, open flow control valve 368 on Well 2 to 100%, and close flow control valve 320 on Well 1 to 50% open and observe the pressure there. Once the pressure has stabilized, close flow control valve 320 on Well 1 to 0% open. Then close upper master valve 314 on Well 1. Equalize the pumpdown iron (now shown) to the wellhead pressure of Well 1 and open pumpdown valves 310, 312. Then open pumpdown bleed-off line to flowback tank, allowing the pressure in the wellhead of Well 1 to reach zero or allow the pressure to escape through flowback valves 304, 306. Now the pressure on Well 2 can be increased as allowed and the next frac stage for Well 2 can be achieved. At this point, Well 1 is bled off to 0 psi and is prepared for wireline operations and Well 2 can begin the next stage. The primary difference between FIGS. 2 and 3 is the number of zipper valves at the frac manifold for Wells 1 and 2 (two zipper valves in FIG. 2 and one zipper valve in FIG. 3).

Figure 4:
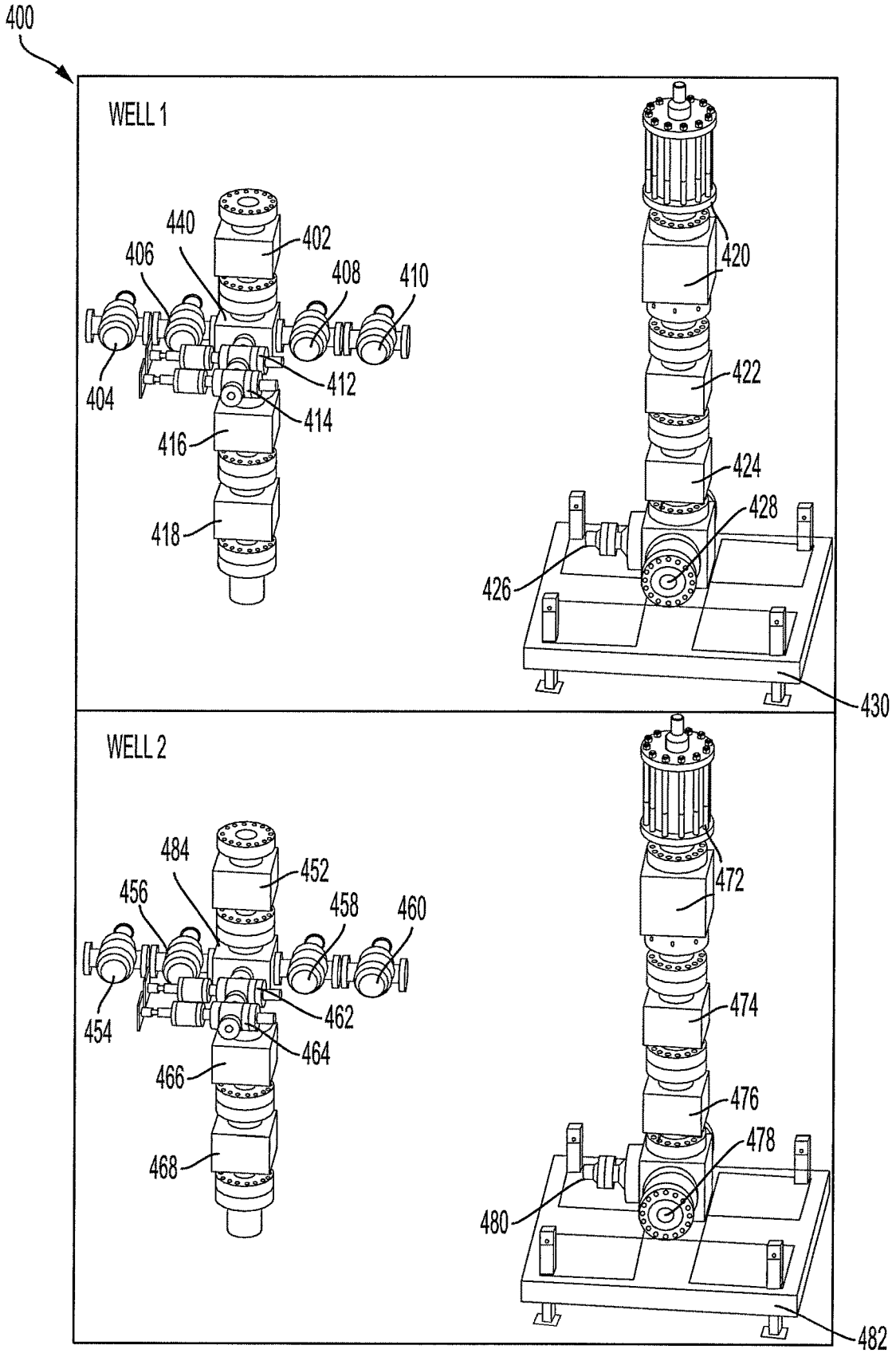
FIG. 4 shows an alternative embodiment for two wells with frac trees and frac manifolds that operate according to certain embodiments of the present invention.

In the configuration shown in FIG. 4, the two frac manifold portions and frac trees are similar 400. Swab valves 402, 452, crosses 440, 484, upper master valves 416, 466, and lower master valves 418, 468 make up the vertical portion of the frac trees for Well 1 and Well 2. Flowback valves 404, 406, 454, 456 and pumpdown valves 408, 410, 458, 460 make up the horizontal portions of frac trees for Well 1 and Well 2. The frac trees of FIG. 4 also contain equalizing port valves 412, 414, 462, 464. The frac trees shown in FIG. 4 represent the frac trees 110, 120, 130, and 140 shown in FIG. 1. Tree caps are not shown in FIG. 4. Flow control valves 420, 472, upper zipper valves 422, 474, lower zipper valves 424, 476, and connection blocks 428, 478 make up the frac manifolds for Well 1 and Well 2. In contrast to FIGS. 2-3, outlets 426, 480 are also connected to connection blocks 428, 478 accordingly. Skids 430, 482 are used to anchor the frac manifolds for Well 1 and Well 2. The portions of the frac manifold shown in FIG. 4 represent frac manifold portions 112, 122, 132, and 142 in FIG. 1. Equalizing port valves at the frac tree and the outlets at the frac manifold are designed to further connect or create a loop between the frac tree and frac manifold to enable the equalization of pressure.

For the scenario shown in FIG. 4, Well 1 is fracking at close to 9,000 psi treating pressure and Well 2 has been bled off and is at 0 psi above the upper master valve 466. Now it is time to prepare for the well swap from Well 1 to Well 2. Initially, the equalizing port valves 462, 464 are opened on the frac tree for Well 2 to allow the pressure from outlet 480 to reach flow control valve 472. Then, flow control valve 472 is partially opened to allow pressure to access zipper valves 474, 476. The operator then must equalize Well 2 wellhead pressure with Well 1 frac treating pressure utilizing equalizing loop, thereby creating minimal pressure differential across zipper valves 474, 476. Once the pressure differential is achieved, close flow control valve 472 to trap the equivalent treating pressure between the zipper valves 474, 476 and the flow control valve 472. Open zipper valves 474, 476, then bleed off pressure and equalize wellhead pressure with Well 2 formation pressure utilizing pumpdown bleed-off line (not shown), or with flowback valves 454, 456. Other means may also be used to bleed off pressure. After the pressure is equalized, open upper master valve 466. Then close equalizing port valves 462, 464 and bleed off pressure in equalizing loop lines (not shown). Well 2 is now open and ready for fracturing operations. Make sure to allow adequate time to achieve these steps before swapping wells and finishing the stage on Well 1.

Once the fluid flush and overflush volumes have reached the perforated areas of the well, open flow control valve 472 on Well 2 to 100%, and close flow control valve 420 on Well 1 to 50% open and observe the pressure there. Once the pressure has stabilized, close flow control valve 420 on Well 1 to 0% open. Then close upper master valve 416 on Well 1. Open equalizing port valves 412, 414 to bleed off through equalizing loop (not shown) wellhead pressure of Well 1. Then close equalizing port valves 412, 414. Now the pressure on Well 2 can be increased as allowed and the next frac stage for Well 2 can be achieved. At this point, Well 1 is bled off to 0 psi and is prepared for wireline operations and Well 2 can begin the next stage.

Figure 5:
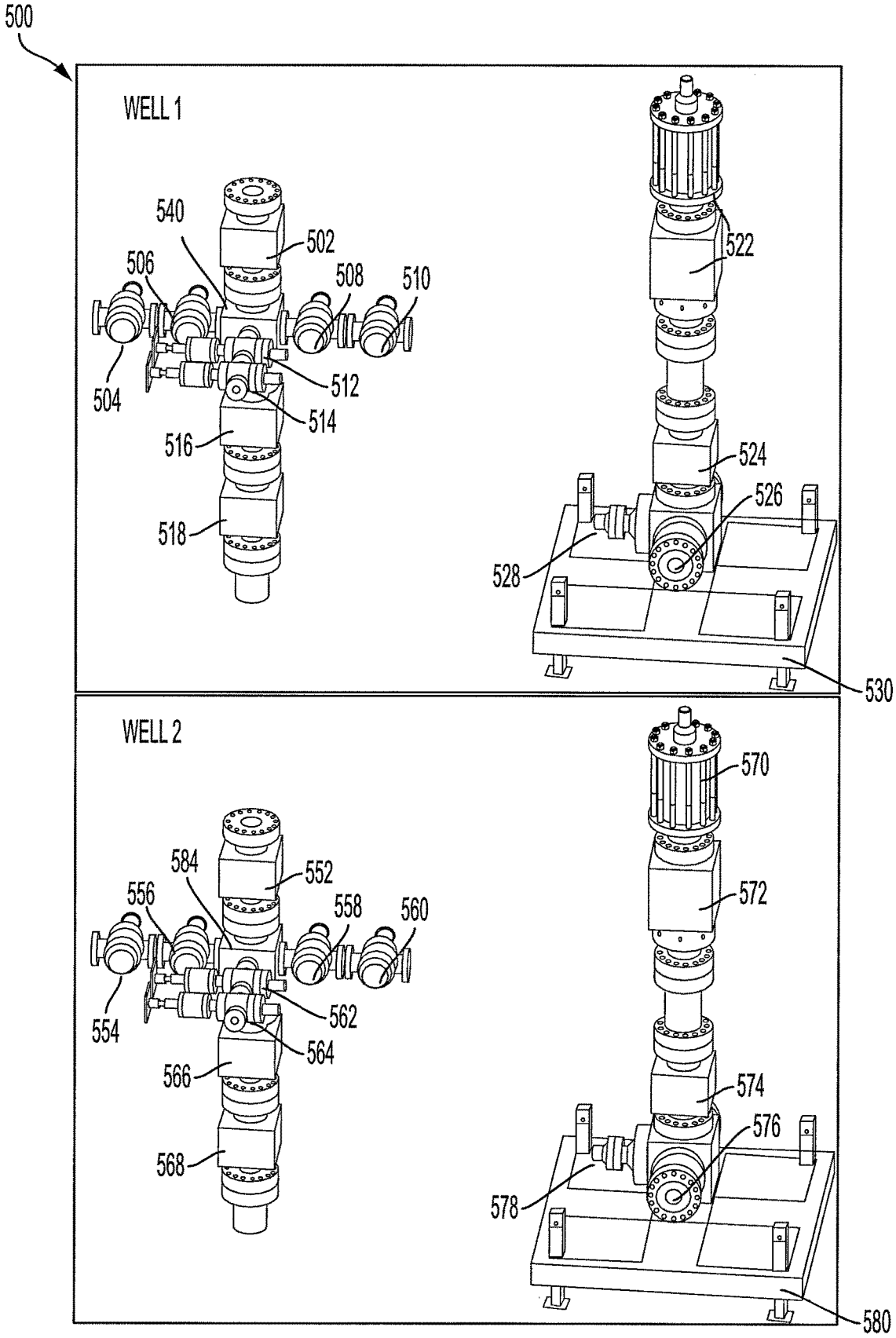
FIG. 5 shows an alternative embodiment for two wells with frac trees and frac manifolds that operate according to certain embodiments of the present invention.

In the configuration shown in FIG. 5, the two frac manifold portions and frac trees are similar 500. Swab valves 502, 552, crosses 540, 584, upper master valves 516, 566, and lower master valves 518, 568 make up the vertical portion of the frac trees for Well 1 and Well 2. Flowback valves 504, 506, 554, 556 and pumpdown valves 508, 510, 558, 560 make up the horizontal portions of frac trees for Well 1 and Well 2. The frac trees of FIG. 5 also contain equalizing port valves 512, 514, 562, 564. The frac trees shown in FIG. 5 represent the frac trees 110, 120, 130, and 140 shown in FIG. 1. Tree caps are not shown in FIG. 5. Flow control valves 522, 572, zipper valves 524, 574, and connection blocks 526, 576 make up the frac manifolds for Well 1 and Well 2. In contrast to FIGS. 2-3, outlets 528, 578 are also connected to connection blocks 526, 576 accordingly. Skids 530, 580 are used to anchor the frac manifolds for Well 1 and Well 2. The portions of the frac manifold shown in FIG. 5 represent frac manifold portions 112, 122, 132, and 142 in FIG. 1.

For the scenario shown in FIG. 5, Well 1 is fracking at close to 9,000 psi treating pressure and Well 2 has been bled off and is at 0 psi above the upper master valve 566. Now it is time to prepare for the well swap from Well 1 to Well 2. Initially, the equalizing port valves 562, 564 are opened on the frac tree for Well 2 to allow the pressure from outlet 578 to reach flow control valve 572. Then, flow control valve 572 is partially opened to allow pressure to access zipper valve 574. The operator then must equalize Well 2 wellhead pressure with Well 1 frac treating pressure utilizing equalizing loop, thereby creating minimal pressure differential across zipper valve 574. Once the pressure differential is achieved, close flow control valve 572 to trap the equivalent treating pressure between the zipper valve 574 and the flow control valve 572. Open zipper valve 574 then bleed off pressure and equalize wellhead pressure with Well 2 formation pressure utilizing pumpdown bleed-off line (not shown), or with flowback valves 556, 554. Other means may also be used to bleed off pressure. After the pressure is equalized, open upper master valve 566. Then close equalizing port valves 562, 564 and bleed off pressure in equalizing loop lines (not shown). Well 2 is now open and ready for fracturing operations. Make sure to allow adequate time to achieve these steps before swapping wells and finishing the stage on Well 1.

Once the fluid flush and overflush volumes have reached the perforated areas of the well, open flow control valve 572 on Well 2 to 100%, and close flow control valve 522 on Well 1 to 50% open and observe the pressure there. Once the pressure has stabilized, close flow control valve 522 on Well 1 to 0% open. Then close upper master valve 516 on Well 1. Open equalizing port valves 512, 514 to bleed off through equalizing loop (not shown) wellhead pressure of Well 1. Then close equalizing port valves 512, 514. Now the pressure on Well 2 can be increased as allowed and the next frac stage for Well 2 can be achieved. At this point, Well 1 is bled off to 0 psi and is prepared for wireline operations and Well 2 can begin the next stage. The primary difference between FIGS. 4 and 5 is the number of zipper valves at the frac manifold for Wells 1 and 2 (two zipper valves in FIG. 4 and one zipper valve in FIG. 5). FIGS. 2-5 represent embodiments of the present invention and do not limit the present invention to these embodiments.

FIG. 6 shows a flow control valve 600 that may operate in a frac manifold according to certain embodiments of the present invention. This flow control valve may represent valves 220, 268, 320, 368, 420, 472, 522, 572 in FIGS. 2-5. This flow control valve 600 may also be used in other parts of a frac system, including in frac trees or frac manifolds (i.e., zipper valves, master valves). A valve body 620 makes up a housing for the flow control valve 600. The valve body 620 may be a machined steel block. A hydraulic cylinder 602 may include a piston head 604 may be connected to a stem 606 that protrudes through the valve body 620, which is connected to a gate 610. The gate 610 controls the flow of water and/or frac fluid through a valve cavity of the flow control valve 600. A stem packing 608 in combination with a seal assembly 632 isolates the pressure between the inside of the valve body 620 (valve cavity) and the inside of a hydraulic actuator cavity 630 and provides the flexibility for the stem 606 to move without allowing any of the water and/or frac fluid to enter the portion of the hydraulic actuator cavity 630. The piston 604 moves within the hydraulic actuator cavity 630. A seat 612 is located at the opposite end of the piston 604 to stop and prevent the gate 610 from moving when the valve is in the closed position. In some embodiments, the seat 612 may be held in place with a first removable locking pin 614 and/or a second removable locking pin 616 and/or a series of locking pins. The water and/or frac fluid flows from an inlet at the lower portion to an outlet at the left portion of the flow control valve 600, wherein the gate 610 can stop the flow if engaged with the seat 612 (closed position) or allow the water and/or frac fluid to flow in the open position. Hydraulic hoses 644 may be used to connect to a hydraulic pressure unit (not shown) to control the movements of the piston 604 and the connected gate 610. An external actuator housing and a control panel with pressure gauges (hydraulic pressure unit) may be included to control the hydraulic pressure applied to the piston 604.

In some embodiments, the valve body 620 may provide the housing for the valve and include a flanged or studded flow inlet, outlet, and actuator housing. In operation, hydraulic fluid from the hydraulic pressure unit (not shown) pressures one side of the piston 604 within the hydraulic actuator housing 630 to advance the stem 606 and gate 610 to the seat 612 in a linear motion until the gate 610 engages with the seat 612. The removable locking pins 614, 616 hold the seat 612 in the desired position, and can be backed off to change out the seat 612 if needed. For example, if the gate 610 engages the seat 612 at a higher position in the valve cavity, then more water and/or frac fluid can flow through the valve 600. If the gate 610 engages the seat 612 at a lower position in the valve cavity, then less or no water and/or frac fluid may flow through. Thus, control of the piston 604 and sequentially control of the gate 610 can increase or decrease an equivalent hydraulic diameter of a flow path for the valve 600, thereby gradually opening or closing the valve 600. This embodiment provides a variable condition flow control valve that is not only "open" or "closed." Using binary condition valves (only "open" or "closed") to actuate open with differential pressure or actuate closed while flowing fluids through the valve imparts undue strain on the valve and can introduce costly downtime to repair or replace valves during the operation. Additionally, actuation of these types of binary valves while flowing would near-instantly close the flow path, introducing the potential for fluid momentum induced water hammer effect and cause the pressure in the flow iron to exceed the safe working pressure. Exceeding the safe working pressure may rupture the flow path in an explosive manner and rare events of this magnitude have led to equipment damage, personnel injury, and loss of life. Using variable condition flow control valves (FIGS. 2-5) enables the present invention to accomplish the improved well swap.

In some embodiments, this variable condition flow control valve may be capable of opening and closing the fracturing flow path with a differential pressure of up to 15,000 psi, and a flow rate of up to 120 BPM or greater depending on pressure variables, etc. As mentioned above, the equivalent flow diameter is changed gradually to greatly reduce the risk of exceeding the safe working pressure of the fracturing equipment. The valve 600 may provide numerous different conditions (i.e., fully open, partially closed, fully closed) and different flow paths (e.g., 0%, 25%, 50%, 75%, 100%). In some embodiments, the gate of 610 and corresponding valve are larger than conditional flow control valves used in the past due to the capabilities of the valve to be conditionally opened and closed.

Figure 7:
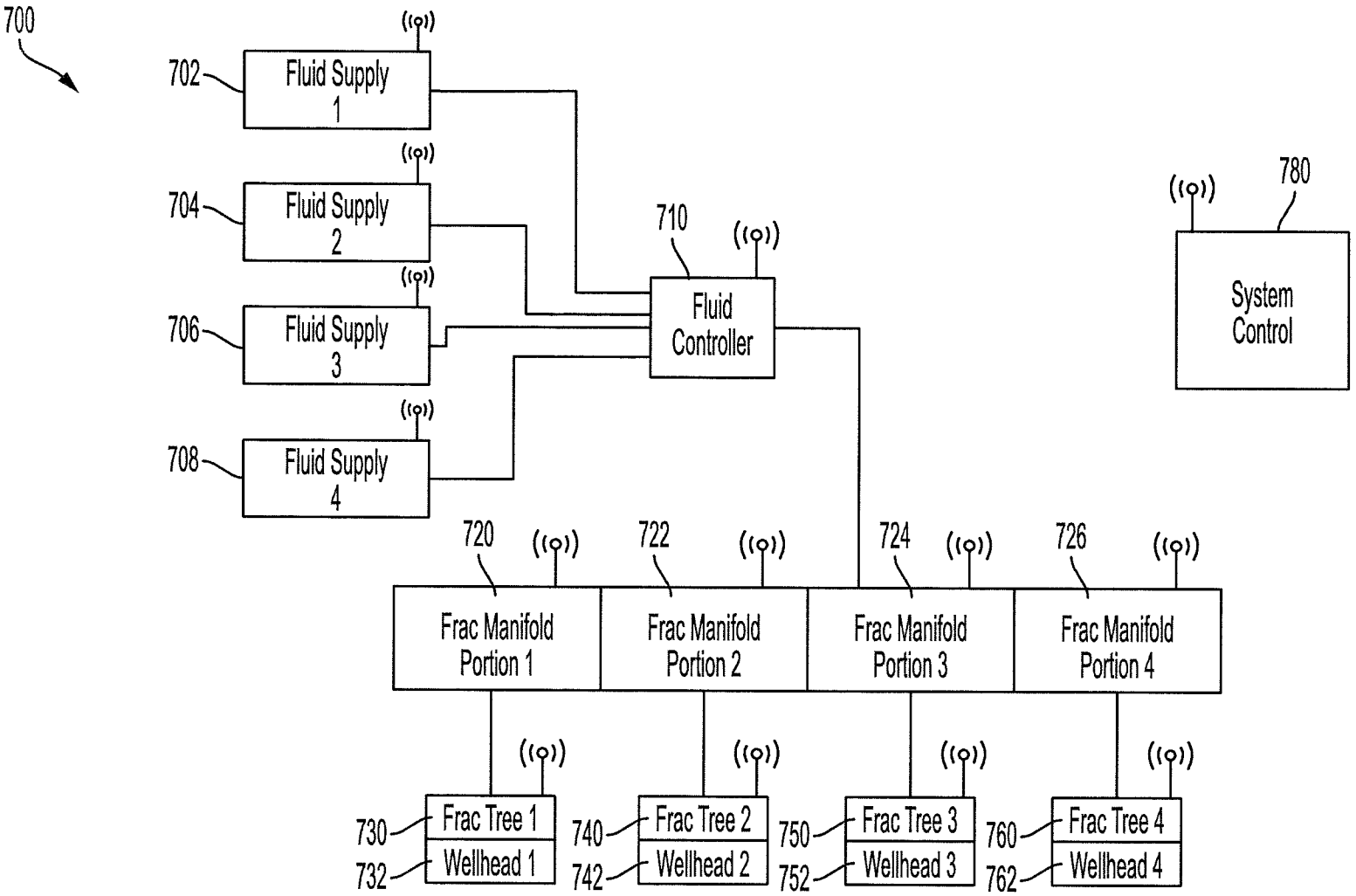
FIG. 7 shows a fracturing system according to some embodiments of the present invention.

FIG. 7 illustrates a frac system 700 according to certain embodiments of the present invention. Fluid supply 1 702, fluid supply 2 704, fluid supply 3 706, and fluid supply 4 708 hold frac fluids for the fracturing operation. These may be frac tanks filled with water and/or frac fluids for delivery to the wells. For most fracturing operations, there are many more fluid supplies due to the vast amount of water and frac fluid required for a fracturing operation. The fluid supplies 702, 704, 706, and 708 are connected to a fluid controller 710 that controls the outflow of water and/or frac fluids. Fluid controller 710 may comprise a number of pumps and corresponding controller for the pumps. For example, fluid controller 710 may allow the water and/or frac fluid from fluid supply 1 702 to flow to the frac manifold until empty, and then allow the water and/or frac fluid from fluid supply 2 704 to flow to the frac manifold. Various configurations of connected pipes, hoses, pumps, valves, and controls may be used to manage the water and/or frac fluids from the frac tanks.

The water and/or frac fluids then flow from the fluid controller 710 to the frac manifold portions 720, 722, 724, 726. The frac manifold portions 720, 722, 724, 726 may represent the frac manifold portions in FIG. 1 112, 122, 132, 142. Initially, frac manifold portion 1 720 may be active to provide the water and/or frac fluid to wellhead 1 732 through frac tree 1 730. After the fracturing operations have completed on wellhead 1 732, then the method disclosed in the present invention may be used to swap to frac manifold portion 2 722, frac tree 2 740, and wellhead 2 742. After the fracturing operations have completed on wellhead 2 742, then the method disclosed in the present invention may be used to swap to frac manifold portion 3 724, frac tree 750, and wellhead 3 752. Then fracturing operations may move to frac manifold portion 4, frac tree 4 760, and wellhead 4 762. Accordingly, the fracturing system 700 can complete fracturing operations on four different wells through the same setup, and/or more wells if needed (e.g., 5, 6, 7, 8, etc.).

As described above, configurations and corresponding valves allow vast amounts of water and/or frac fluid to reach the desired location at high pressures for the fracturing operation. A system control 780 may be installed to control this fracturing system and fracturing operation. In some embodiments the components of the fracturing system (fluid supply, fluid controller, pumps, frac manifold, frac trees) have sensors to detect the state of various valves in the system and corresponding water supply and flow. Pressure sensors may be used to read and transmit pressure readings at various locations within the fracturing system. For example, one or more pressure sensors in a conditional flow control valve may read and transmit pressure readings to system control that may be used to close, partially close, or open the conditional flow control valves. Transceivers may be attached to these components to transmit this data, then the system control 780 can monitor, manage, and control the entire fracturing operation. As discussed above, sensors may also be applied to the valves to enable opening and closing the valves in coordination to further control the fracturing operation. The system control 780 may also comprise an antenna to transmit to and receive signals from the various components during the fracturing operation.

The ability to control the fracturing operation through a system control 780 may take many different forms. For example, the data may be uploaded to a website, where an operator can view and manage the operation through a website portal. The system control 780 may also be offsite with electronic components for wireless reception and transmission onsite to communicate with the various components of the fracturing operation. In some embodiments, the system control 780 may simply be a computer or tablet with corresponding software to run the fracturing operation onsite. By moving control of the fracturing system 700 to a computer, tablet, website, or remote locations, safety may be improved because workers can stay a safe distance away from the fracturing system 700. The method of the present invention may also be controlled by employees or operators of the fracturing site without electronic devices.

Figure 8:
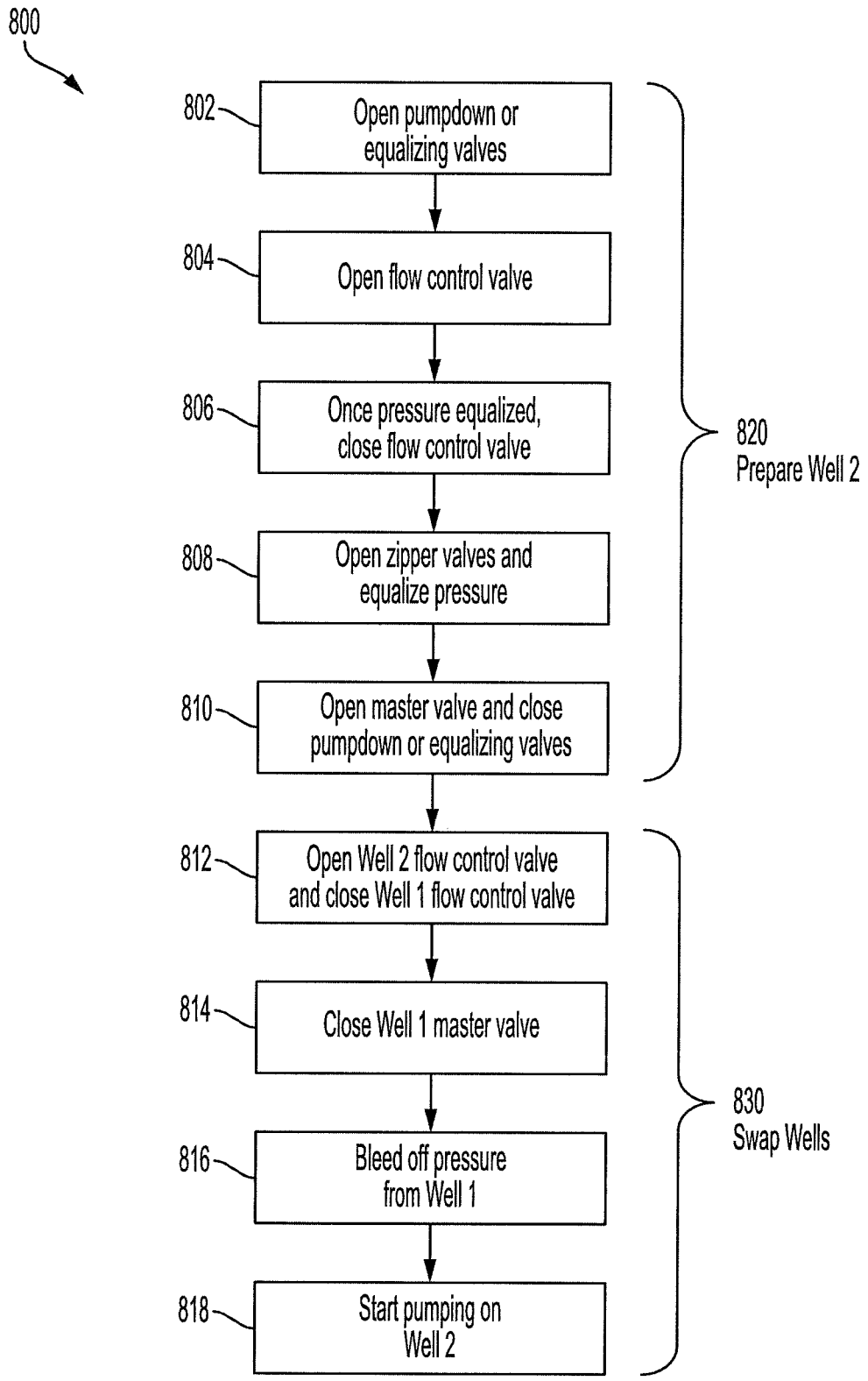
FIG. 8 shows a flow chart describing a method for swapping wells in a fracturing system according to certain embodiments of the present invention.

FIG. 8 shows a flow chart 800 describing a method for swapping wells in a frac system according to the different embodiments described in FIGS. 2-5. Initially, Well 1 is fracking close to 9,000 psi and Well 2 is shut down. When an operator decides to swap Well 1 for Well 2, Well 2 needs to be prepared. First, depending upon the configuration of a frac tree and a frac manifold, pumpdown valves or equalizing valves on the frac tree are opened 802. Then a flow control valve on the frac manifold is opened 804. Once the pressure is equalized, the flow control valve is closed 806 to trap pressure between the flow control valve and a zipper valve(s). Then zipper valves on the frac manifold are opened and pressure is equalized 808. Lastly, a master valve(s) is opened and the pumpdown valves are closed 810. At this point, Well 2 is prepared to start fracturing operations 820.

Next the operator swaps the wells. Initially, the flow control valve is opened for Well 2 and a flow control valve for Well 1 is closed sequentially 812. A multiple condition valve (FIG. 6) allows Well 1 to gradually close (e.g., from 100% to 50% to 0%). A master valve(s) for Well 1 is then closed 814, and the pressure from Well 1 is bled off 816. At this point Well 1 is closed and pumping can begin on Well 2 818. Through this method, the swap from Well 1 to Well 2 can occur without shutting down the entire fracturing operation 830. With prior methods, Well 1 would have to be completely shut down, which included halting all the pumping mechanisms for the fracturing operation. Then, after the complete shut down, all the pumping mechanisms would have to be started up again to begin pumping on Well 2. This would waste time and resources due to the down time of the fracturing operation. In this method, the pumping mechanisms can continue to run during the swap from Well 1 to Well 2, which allows for the continuous pumping of water and/or frac fluid. Thus, the present invention saves time and resources for these types of fracturing operations.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for operation of a multichannel fracturing operation that includes at least a first well and a second well comprising:

supplying a frac fluid to the first well at a first treating fluid pressure, wherein at least one first control valve at a first frac manifold is open during the supplying step;

opening a second control valve at a second frac manifold while the frac fluid is being supplied to the first well at said first treating fluid pressure wherein at least a portion of the frac fluid from the first treating fluid pressure is supplied to said second well;

observing a fluid pressure at the first control valve after the frac fluid is supplied to said second well;

closing the at least one first control valve at the first frac manifold by transitioning to a partially closed state and then to a fully closed state in response to said fluid pressure observations at the at least one first control valve to stop the flow of frac fluid to said first well, wherein the frac fluid is then being supplied to the second well at a second treating fluid pressure; and opening a third control valve at a third frac manifold for a third well while the frac fluid is being supplied to the second well at the second treating fluid pressure wherein at least a portion of the frac fluid from the second treating fluid pressure is supplied to a third control valve while the first control valve remains fully closed.

2. The method of claim 1, wherein the first control valve and the second control valve are conditional control valves.

3. The method of claim 2, wherein the first control valve and the second control valve have at least a fully closed state, a partially closed state, and a fully open state.

4. The method of claim 1, wherein the method further comprises adjusting at least one master valve of a first frac tree and bleeding off pressure from the first well after said closing step.

5. The method of claim 1, wherein the observing step further comprises observing a fluid pressure at the first control valve with a first pressure sensor.

6. The method of claim 5, wherein the first control valve is remotely controlled and the first pressure sensor is remotely observed.

7. The method of claim 6, further comprising observing the fluid pressure at the second control valve with a second pressure sensor.

8. The method of claim 7, wherein the second control valve is remotely controlled and the second pressure sensor is remotely observed.

9. A method for operation of a multichannel fracturing operation with a first well and a second well comprising:

supplying a frac fluid to the first well at a first treating fluid pressure, wherein at least one first control valve at a first frac manifold is open during the supplying step;

opening a second control valve at a second frac manifold while said frac fluid is being supplied to the first well at said first treating fluid pressure wherein at least a portion of the frac fluid from the first treating fluid pressure is supplied to the second well;

observing a fluid pressure at the first control valve after the at least a portion of the frac fluid is supplied to the second well;

adjusting the at least one first control valve at the first frac manifold by transitioning to a partially closed state in response to a first fluid pressure reading at the at least one first control valve;

closing the at least one first control valve to stop the flow of frac fluid to the first well in response to a second fluid pressure reading, wherein the frac fluid is then being supplied to the second well at a second treating fluid pressure; and adjusting at least one master valve of a first frac tree and bleeding off pressure from the first well after said closing step.

10. The method of claim 9, wherein the first control valve and the second control valve are conditional control valves.

11. The method of claim 10, wherein the first control valve and the second control valve have at least a fully closed state, a partially closed state, and a fully open state.

12. The method of claim 9, wherein the observing step further comprises observing the fluid pressure at the first control valve with a first pressure sensor.

13. The method of claim 12, wherein the first control valve is remotely controlled and the first pressure sensor is remotely observed.

14. A non-transitory computer readable medium with computer executable instructions stored thereon executed by a processor to perform a method for continuous operation of a multichannel fracturing operation that includes at least a first well, and a second well, said method comprising:

supplying a frac fluid to the first well at a first treating fluid pressure, wherein at least one first control valve at a first frac manifold is open during said supplying step;

opening a second control valve at a second frac manifold while said frac fluid is being supplied to the first well at said first treating fluid pressure wherein said frac fluid from the first treating fluid pressure is supplied to said second well;

observing a fluid pressure at said first control valve after said frac fluid is supplied to said second well;

adjusting the at least one first control valve at the first frac manifold by transitioning to a partially closed state in response to a first fluid pressure reading at the at least one first control valve;

closing the at least one first control valve to stop the flow of frac fluid to said first well in response to a second fluid pressure reading, wherein the frac fluid is then being supplied to the second well at a second treating fluid pressure; and opening a third control valve at a third frac manifold for a third well while the frac fluid is being supplied to the second well at the second treating fluid pressure wherein at least a portion of the frac fluid from the second treating fluid pressure is supplied to a third control valve while the first control valve remains fully closed.

15. The non-transitory computer readable medium of claim 14, wherein the observing step further comprises observing the fluid pressure at the first control valve with a first pressure sensor.

16. The non-transitory computer readable medium of claim 15, wherein the first control valve is remotely controlled, and the first pressure sensor is remotely observed.

17. The non-transitory computer readable medium of claim 14, wherein the first fluid pressure reading further comprises a first time period where the first pressure reading remains stable.

18. The non-transitory computer readable medium of claim 17, wherein the second fluid pressure reading further comprises a second time period where the second pressure reading remains stable.

19. The non-transitory computer readable medium of claim 14, further comprising adjusting at least one master valve of a first frac tree and bleeding off pressure from the first well after said closing step.

* * * * *